US006467228B1

(12) United States Patent
Wendt et al.

(10) Patent No.: US 6,467,228 B1
(45) Date of Patent: Oct. 22, 2002

(54) HINGED CEILING PANEL

(75) Inventors: Alan C. Wendt, Barrington, IL (US); Merritt W. Seymour, Chicago, IL (US); Gregory M. Ahren, Lakewood, OH (US)

(73) Assignee: USG Interiors, Inc., Chicago, IL (US)

( * ) Notice: Subject to any disclaimer, the term of this patent is extended or adjusted under 35 U.S.C. 154(b) by 0 days.

(21) Appl. No.: 09/721,206

(22) Filed: Nov. 22, 2000

(51) Int. Cl.[7] ..... E04B 1/82

(52) U.S. Cl. ..... 52/506.07; 52/145; 52/475; 52/489; 52/220.6; 52/506.06

(58) Field of Search ..... 52/488, 489, 506.07

(56) References Cited

U.S. PATENT DOCUMENTS

| | | | | | |
|---|---|---|---|---|---|
| 1,997,581 | A | * | 4/1935 | Heeren et al. | 189/85 |
| 2,116,530 | A | | 5/1938 | McCabe | |
| 2,245,785 | A | | 6/1941 | Jentzer, Jr. | |
| 2,710,081 | A | * | 6/1955 | Fink | 189/85 |
| 3,082,487 | A | | 3/1963 | Fowler et al. | |
| 3,550,341 | A | * | 12/1970 | Thompson | 52/488 |
| 4,095,385 | A | | 6/1978 | Brugman | |
| 4,463,537 | A | * | 8/1984 | Rodriquez et al. | 52/489 |
| 4,535,580 | A | | 8/1985 | Shirey | |
| 4,640,064 | A | * | 2/1987 | Goodworth, II | 52/145 |
| 4,696,142 | A | | 9/1987 | Mieyal et al. | |
| 4,760,677 | A | * | 8/1988 | Nassof | 52/484 |
| 4,773,194 | A | * | 9/1988 | Nassof | 52/145 |
| 4,972,648 | A | | 11/1990 | Scherrer | |

* cited by examiner

*Primary Examiner*—Carl D. Friedman
*Assistant Examiner*—Basil Katcheves
(74) *Attorney, Agent, or Firm*—Lee, Mann, Smith, McWilliams, Sweeney & Ohlson; John M. Lorenzen; David F. Janci

(57) ABSTRACT

The invention is directed to a hinged ceiling panel, which is pivotally attached to a suspended ceiling grid structure to provide for a hinged ceiling panel that pivots to allow access to the area above the grid. The hinged ceiling panel includes a hinge located on a first edge and grid-releasable flanges located on the remaining edges of the panel. The hinged ceiling panel is designed so that a single person can easily release the panel from the grid system and pivot it downwards whereby the hinge supports it. The hinged ceiling panel is also designed so that an individual can also reposition the panel within the grid structure without the aid of others.

9 Claims, 4 Drawing Sheets

HINGED CEILING PANEL

BACKGROUND OF THE INVENTION

This invention relates generally to suspended ceiling systems and more particularly to a novel and improved system using ceiling panels that include a hinge allowing the ceiling panel to pivot downward so access to the area above the suspended ceiling system can obtained.

PRIOR ART

Suspended-ceiling systems typically include grid members that provide for oppositely extending ceiling panel support flanges. In these systems, the edges of the ceiling panels are installed by laying them in the panel opening created by the grid members. There are also suspended-ceiling systems that have grid members, which include channels designed to grip the vertically extending edges of metal ceiling panels. These ceiling panels are typically installed by snapping the flanges up into the grid member channel, and are generally referred to as "snap-up ceiling panels." To access the area above the suspended-ceiling systems, the ceiling panels need to be completely removed from the grid and placed upon the floor or leaned against a wall where damage to the panel can result. The need to completely remove and install the panel each time access is needed above the grid system can be cumbersome and difficulty may arise when trying to realign the panel during installation especially for large 4 foot×4 foot panels. Prior art devices do not provide for a pan-style panel that allows easy access to the area directly above the suspension-ceiling system.

SUMMARY OF THE INVENTION

This invention may be described as a novel and improved suspension ceiling panel that includes a modified edge that acts similar to a hinge so that the panel can be pivoted downward allowing access to the area above the suspended ceiling. Once the panel is pivoted to the open position, the panel can be allowed to hang, supported by the hinge. The hinged ceiling panel is fabricated out of a single piece of metal, and does not require the use of fasteners for installation. The ceiling panel is formed of sheet metal having a planar surface surrounded by upwardly extending support flanges on three edges. The first edge of the ceiling panel includes an L-shaped hinge. Horizontal ribbing is formed in the upwardly extending support flanges to create a detent that snaps into the assembled grid to secure the panels. The ceiling panel is installed by inserting the L-shaped hinge into the channel at the bottom of the assembled grid first. Once the L-shaped hinge is properly in position, the panel can be pivoted upwardly so that the three support flanges can be snapped in to the channel in the grid.

The panels are formed by die-cutting a piece of sheet metal, which is relatively planar, into the correct size for the ceiling grid opening. While the panel is being cut, detents are simultaneously being formed on three of the edges of the panel. After the panel has been die cut, the three edges are die-bent upward to form the required flanges. The fourth edge is die-bent upward and inward to form the L-shaped hinge.

These and other aspects of this invention are illustrated in the accompanying drawings, and are more fully described in the following specification.

DETAILED DESCRIPTION OF THE INVENTION

While the present invention will be described fully hereinafter with reference to the accompanying drawings, in which a particular embodiment is shown, it is understood at the outset that persons skilled in the art may modify the invention herein described while still achieving the desired result of this invention. Accordingly, the description which follows is to be understood as a broad informative disclosure directed to persons skilled in the appropriate arts and not as limitations of the present invention.

Figure 1:
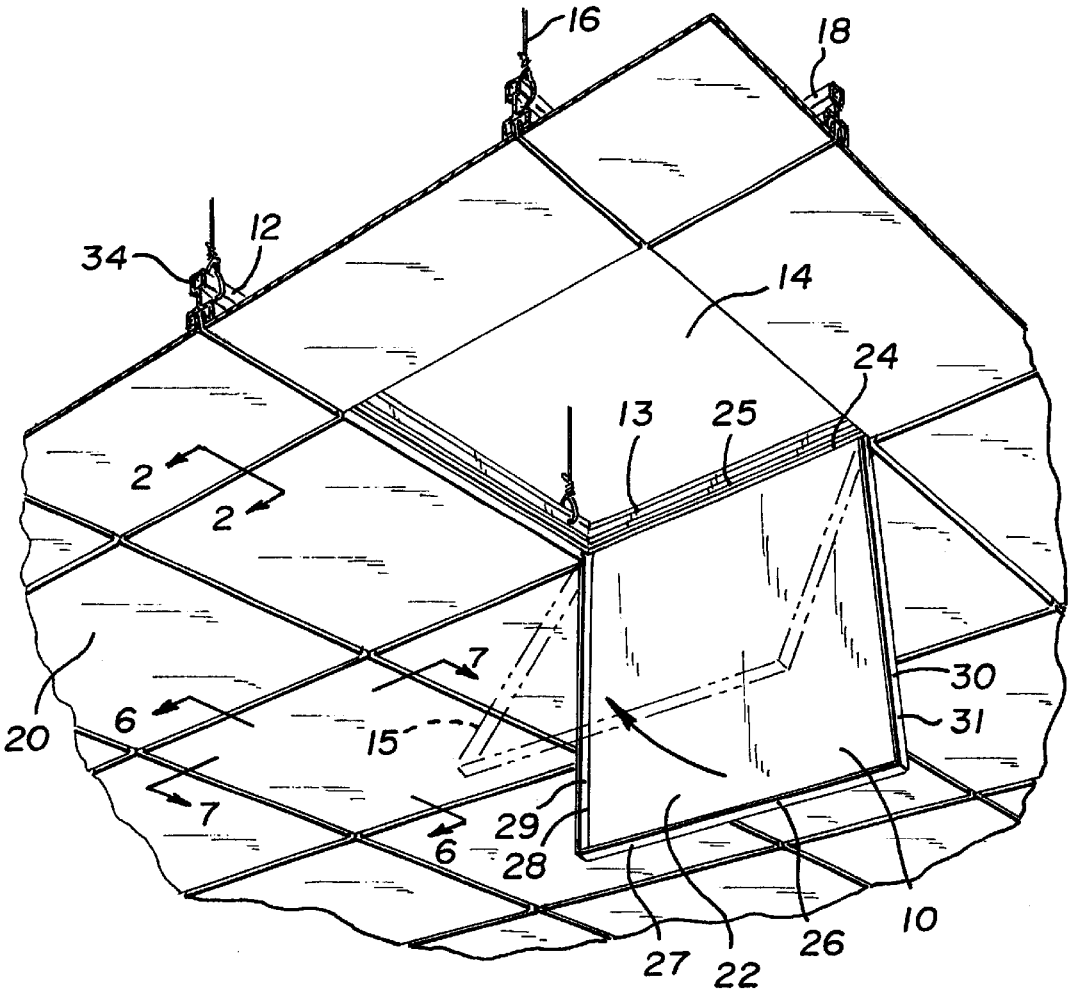
FIG. 1 is a perspective view of a hinged metal ceiling panel of the present invention attached to a ceiling grid system and hinged in the open position.

FIG. 1 illustrates a portion of an assembled suspension ceiling incorporating hinged snap-up ceiling panels 10 in accordance with the present invention. In such a ceiling panel system, grid members 12 are interconnected to form a grid structure 13. The grid members 12 are arranged to form openings 14 sized to receive the ceiling panels 10. The grid members 12 are suspended from the building structure by wire hangers 16 or other supporting structures.

To create the grid structure 13, a row of parallel evenly spaced grid members 12 are suspended by wire hangers 16. Each row of the grid members 12 are spaced apart to accommodate the size of the hinged ceiling panels 10. To accommodate a 4 foot by 4 foot ceiling panel, the grid members 12 would be spaced apart 4 feet on-center. The grid structure 13 also includes a second set of grid members 18 that are perpendicularly oriented in relation to the first set of grid members 12 to create the opening required for hanging the panels 10.

The hinged snap-up ceiling panels 10 are normally rectangular, usually square in shape, and are typically made out of metal. Depending upon the ceiling design used, it may be desirable to shape the panels 10 into a rectangular shape but other shapes may be utilized. The hinged ceiling panels 10 include a bottom surface 20 and a top surface 22. The panels 10 also include a hinge 24 along a first edge 25 and three flanges 26, 28 and 30 along second, third and fourth edges 27, 29, 31. The hinged snap-up ceiling panel 10, as shown in FIG. 1, is shown pivotally connected to the grid structure 13 by the hinge 24 creating an axis of rotation. When the ceiling panel 10 is pivoted to the open position, the weight of the ceiling panel 10 is completely supported by the interaction between the grid member 12 and the hinge 24. Ghost lines 15 show the ceiling panel 10 transitioning from an open position to a closed position. It is beneficial to have the hinge 24 support the ceiling panel 10 because when all metal ceiling panels become as large as 4 feet by 4 feet, they become awkward to install and remove due to their relatively large size and weight. When working with a piece of sheet metal with such a large surface, any improper handling will result in damage to the overall finish of the ceiling panel 10. Also, by using the hinge 24 that spans the length of the ceiling panel 10, the weight of the panel is evenly distributed across the entire edge 24 of the panel 10, preventing rippling that would be apparent in the bottom surface 20 of the panel 10. Furthermore, once the ceiling panel 10 is connected to the grid members 12, the ceiling panel 10 will automatically be in alignment to allow for easy closure by pivoting the ceiling panel 10 upward and snapping in the three other flanges 26, 28 and 30.

Figure 2:
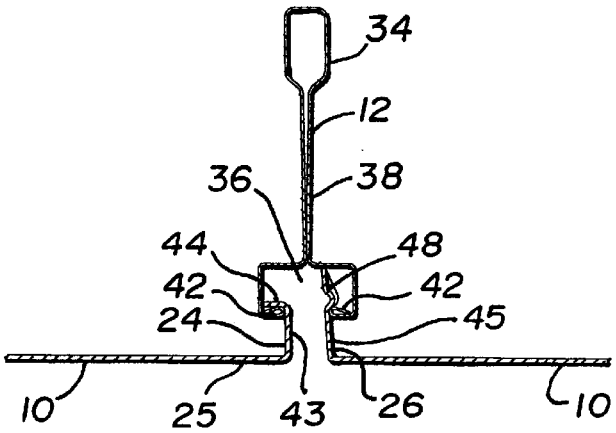
FIG. 2 is a cross section of FIG. 1 illustrating a hinge from one panel and a flange from another panel positioned within a channel of a grid member.

FIG. 2 is a cross section of FIG. 1 taken along line 2—2 looking in the direction of the arrows and shows the grid member 12 and the hinge 24 along the first edge 25 of a first ceiling panel 10 and the flanged edge 26 of a second ceiling panel 10. The grid member 12 is fabricated out of a single piece of die-formed sheet metal. The grid member 12 after fabrication includes a bulb portion 34, a channel 36 and a double layer bridge portion 38 that connects the bulb portion 34 and the channel 36. The overall shape of the grid member 12 is to give the member 12 strength to prevent flexing. Typically, apertures (not shown) are placed along the length of the bridge portion 38 so that wire hangers 16 can be threaded through and wrapped around the bulb portion 34. Once the wire hanger 16, as shown in FIG. 1, which can be in the form of a wire, is threaded through an aperture (not shown) and around the bulb portion 34, the wire hanger 16 is wrapped around itself several times to prevent it from unraveling. The bridge portion 38 typically includes slots (not shown) that allow one grid member 12 to be connected to the second grid member 18 to form the grid structure 13. The channel 36, as shown in FIG. 2 is formed by bending the double layers of the bridge portion 38, 90 degrees outward, 90 degrees downward and 90 degrees inward to form a boxed channel 36. Bottom edges 42 are folded over to act as a detent surface for the flange 26 and a retaining surface for the hinge 24. The hinge 24 is formed in the ceiling panel 10 by die-forming the hinge 24 90 degrees upward to create an upwardly extending leg 43 and then die-forming the edge 90 degrees inward to create an inward lip 44. The inward lip 44 of the hinge 24 rests upon the bottom edge 42 in the channel 36 of the grid member 12. The flange 26, shown in FIG. 2, is formed by die-forming the edge 26 of the ceiling panel 10 upward 90 degrees to form a vertical member 45 and by forming a detent 48. The ceiling panel 10 is retained to the grid structure 13 by forcing detent 48 past the bottom edge 42. The detent 48 is properly positioned within the channel 36 when the detent 48 is resting upon the bottom edge 42. The vertical member 45 biases the detent 48 to prevent the ceiling panel 10 from moving out of position.

Figure 3:
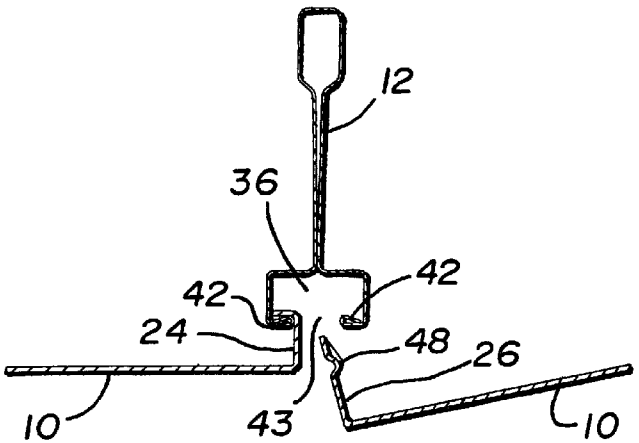
FIG. 3 is a cross section illustrating a hinge from one panel positioned within a channel of a grid member and a flange from another panel outside of the channel prior to installation.

FIG. 3 is a cross section of a ceiling system as in FIG. 2 that shows the grid member 12 and the hinge 24 of a first ceiling panel 10 and a disengaged flange 26 of a second ceiling panel 10. When a panel is released from the grid structure 13, as shown by the second panel in FIG. 3, enough downward force is applied to the ceiling panel 10 to force the detent 48 of the flanges 26, 28 and 30 from the bottom edge 42 of the grid members 12. The spacing 43 between the bottom edges 42 is wide enough to allow the flange 26 to be released from the channel 36 of the grid member 12 without interfering with the hinge 24.

Figure 4:
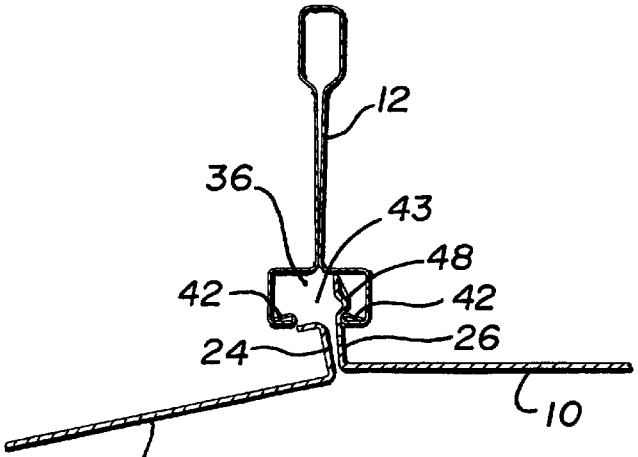
FIG. 4 is a cross section illustrating a flange from one panel positioned within a channel of a grid member and a hinge from another panel outside of the channel in the proper position for installation.

FIG. 4 illustrates a cross section of a ceiling system as in FIG. 2 that shows the grid member 12 and a disengaged position of the hinge 24 of a first ceiling panel 10 and the flange 26 of a second ceiling panel 10. The flange 26 is biased against the bottom edge 42 within the channel 36 of the grid member 12. The disengaged hinge 24 is shown in the proper position for insertion into the channel 36 so the first ceiling panel 10 can be properly installed. The spacing 43 between the bottom edges 42 is wide enough to permit the installation of the hinge 24 without interfering with the flange 26.

Figure 5:
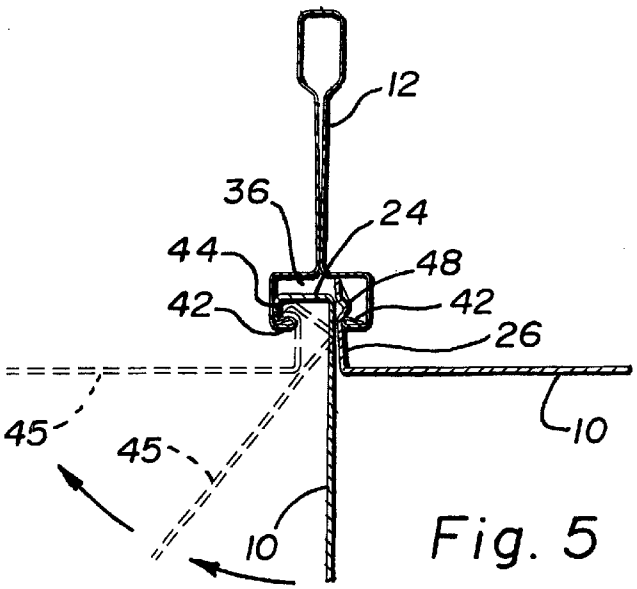
FIG. 5 is a cross section a hinged panel using ghost lines to illustrate the movement of the hinge during the closing of the panel.

FIG. 5 is a cross section of a ceiling system as in FIG. 2 that shows a grid member 12 and the hinging movement of the hinge 24 of a first ceiling panel 10 and the flange 26 of a second ceiling panel 10. Ghost lines 45 illustrate the movement of the hinge 24 during the closing of the first ceiling panel 10. The inward lip 44 of the hinge 24 maintains contact with the bottom edge 42 during the opening and closing of the ceiling panel 10. The hinge 24 is sized so that it does not contact the flange 26 of the second ceiling panel 10 during the opening and closing of the first ceiling panel 10.

Figure 6:
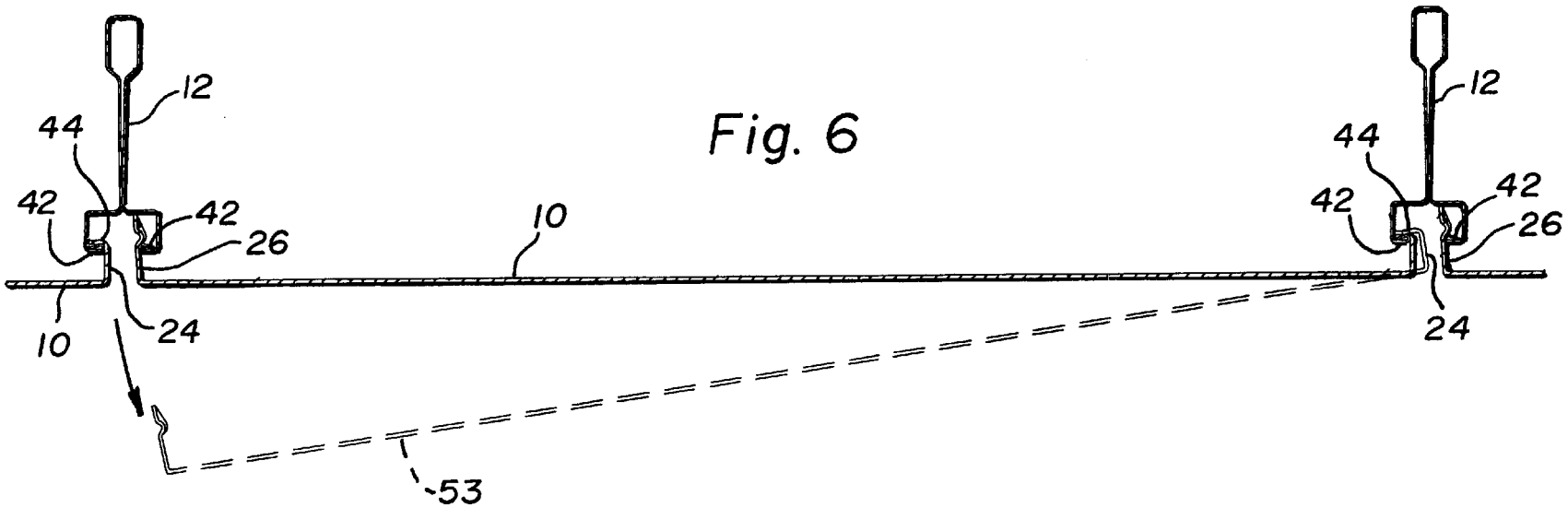
FIG. 6 is a cross section of FIG. 1 illustrating a hinged ceiling panel spanning from one grid member to another grid member using ghost lines to illustrate the panel in the open position. The panel is attached to the first grid member by use of a first flange and attached to the second grid member by use of a hinge.

FIG. 6 is a cross section of the ceiling system of FIG. 1 taken along line 6—6 looking in the direction of the arrows and shows a pair of parallel grid members 12 and a ceiling panel 10 that includes a flange 26 and a hinge 24. The ceiling panel 10 position is maintained between the parallel grid members 12 by the biasing of the flange 26 against the bottom edge 42 of the grid member 12. The ghost lines 53 illustrate the movement of the ceiling panel 10 as it is lowered from a closed position to an open position. As the ceiling panel 10 opens, it is pivoted about the hinge 24 at a point where the inward lip 44 contacts the bottom edge 42. The opening of the ceiling panel 10 does not disturb the other ceiling panels 10 in the grid structure 13.

Figure 7:
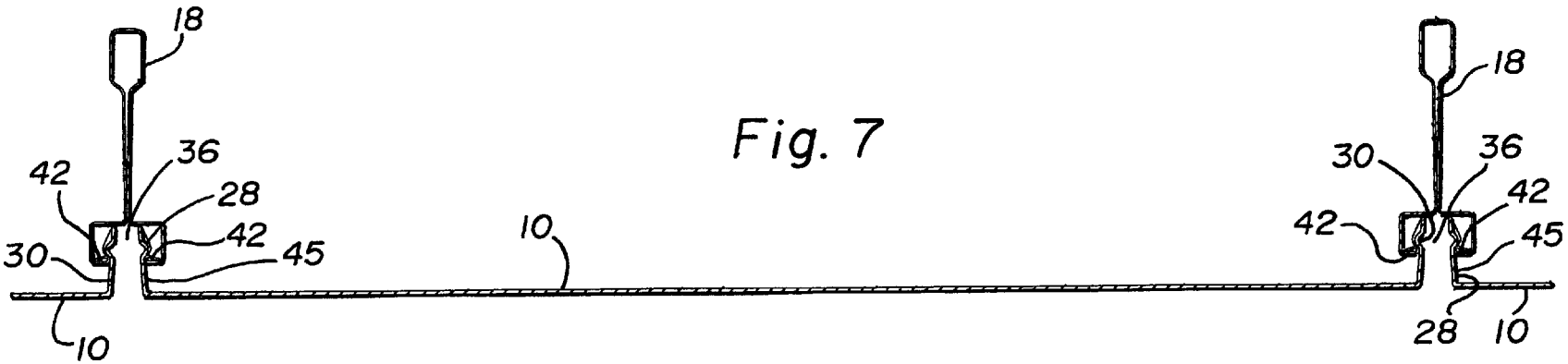
FIG. 7 is a cross section of FIG. 1 illustrating a hinged ceiling panel spanning from one grid member to another grid member with a second and a third flanges inserted into the grid channels.

FIG. 7 is a cross section of the ceiling system of FIG. 1 taken along line 7—7 looking in the direction of the arrows and shows the flange 28 and the flange 30 of a ceiling panel 10 installed between two parallel grid members 18. The flanges 28 and 30 are designed so that that the vertical members 45 are biased against the bottom edges 42 of the grid members 18. Upon the opening of the ceiling panel 10, as in FIG. 6, both flanges 28 and 30, along with transverse flange 26, will be released from their respective channels 36.

Figure 9:
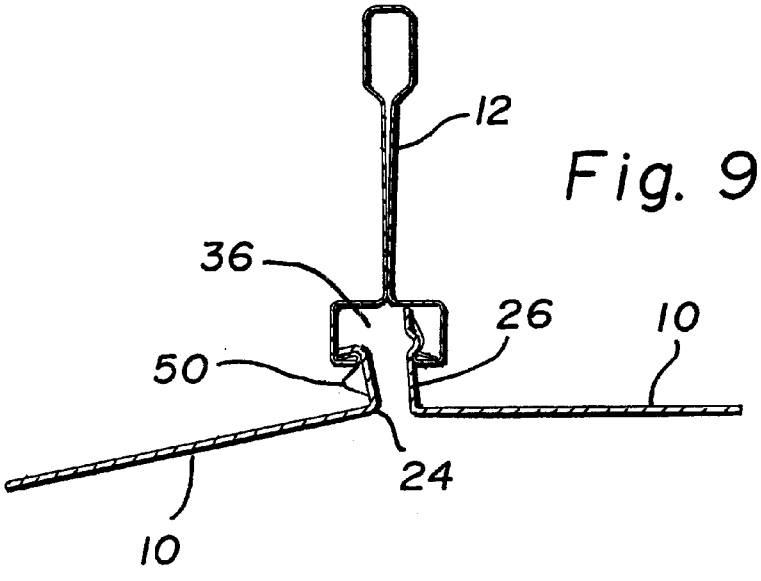
FIG. 9 is a cross section of an alternative embodiment of a hinged panel.
Figure 8:
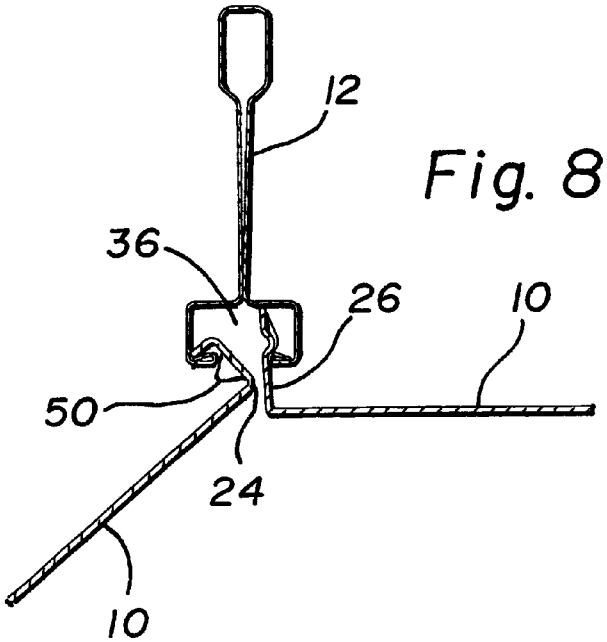
FIG. 8 is a cross section of an alternative embodiment of a hinged panel.
Figure 10:
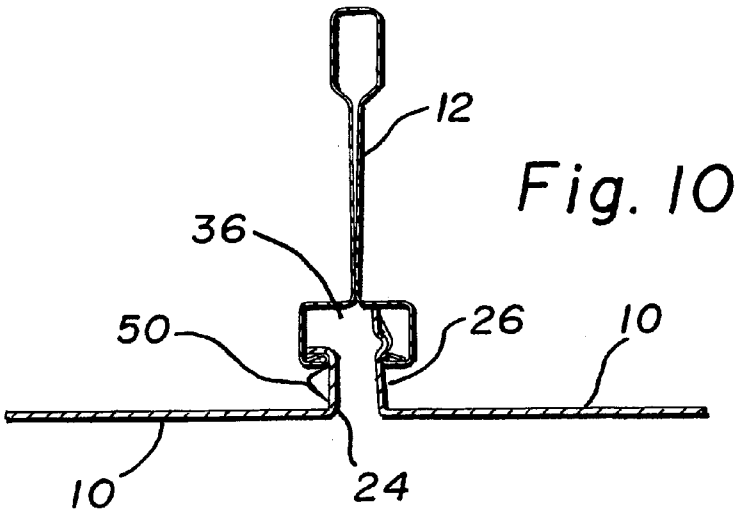
FIG. 10 is a cross section of an alternative embodiment of a hinged panel.

FIGS. 8–10 are cross sections of a ceiling system as in FIG. 2 that show the grid member 12 and an alternate embodiment of the hinge 24 of a first ceiling panel 10. The hinge 24 includes dimples 50, evenly spaced along the length of the hinge 24, which aid in guiding the hinge 24 into the proper location within the channel 36. The dimples 50 also prevent unwanted vertical movement of the panel 10 when it is in the closed position, as shown in FIG. 10. A continuous longitudinal dimple or projection is yet another alternative configuration.

The hinged snap-up ceiling panels 10 are designed so that an individual can open and close a 4-foot×4-foot ceiling panel 10 without the aid of other workers. Since the hinge

24 maintains contact with the bottom edge 42 of the grid member 12 during the opening and closing of the ceiling panel 10, the alignment of the ceiling panel 10 with respect to the opening 14 in the grid structure 13 is maintained.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A hinged ceiling panel for attachment to suspension ceiling grids formed of intersecting grid members having channels comprising:

a body having a first edge and a second edge;

a flange formed on said first edge of said body, said flange being generally perpendicular to said body of said panel;

a detent extending panel-inward from said flange, said flange adapted to releasably bias said detent against a channel of a grid member;

a hinge formed on said second edge of said body having an upwardly extending leg that is generally perpendicular to said body of said panel;

said leg including a lip that is generally perpendicular to said leg and extends toward said first edge of said body, said hinge is pivotally attachable to a channel of a grid member allowing said panel to be pivoted from a horizontal position to a generally vertical position, said hinge adapted to remain pivotally attached to a channel and fully support said panel after said first edge of said body is released from a channel; and said panel can be pivoted from a horizontal position to a generally vertical position by releasing said detent from a channel and pivoting said panel about said hinge.

2. The hinged ceiling panel of claim 1, wherein said channel including a bottom edge adapted to support said inwardly extending lip of said hinge.

3. The hinged ceiling panel of claim 1, wherein said ceiling panel, said hinge and flanges are fabricated out of a single unitary piece of metal.

4. The hinged ceiling panel of claim 1, wherein said upwardly extending leg includes a dimple to guide said hinge.

5. A suspended ceiling system comprising:

a grid formed of intersecting grid members to form openings for ceiling panels; said grid members including a channel;

a ceiling panel having a body with a first edge and a second edge, said ceiling panel adapted to be pivotally connected to said grid members at one of said openings;

a flange formed on said first edge of said panel that is generally perpendicular to said body of said ceiling panel;

a detent extending panel-inward from said flange, said flange adapted to releasably bias said detent against a channel of said grid member;

a hinge formed on said second edge of said body and including a leg that is generally perpendicular to said body of said ceiling panel, said leg including a lip that is generally perpendicular to said leg and extending toward said first edge of said body, said hinge adapted to remain pivotally attached to a channel and fully support said panel after said first edge of said panel is released from a channel of a said grid member; and said panel can be pivoted from a grid opening by releasing said detent from a said channel and pivoting said panel about said hinge from a horizontal position to a generally vertical position.

6. The suspension ceiling system of claim 5 wherein said outwardly extending leg includes a plurality of dimples to guide said hinge.

7. The suspension ceiling system of claim 5, where in said ceiling panel includes a second flange along a third edge, said second flange including a vertical member and a detent, said detent is biased against said channel by said vertical member.

8. The suspension ceiling system of claim 5, wherein said ceiling panel includes a third flange along a fourth edge, said third flange including a vertical member and a detent, said detent is biased against said channel by said vertical member.

9. The suspension ceiling system of claim 8 wherein said ceiling panel, said hinge and said flanges are fabricated out of a single unitary piece of metal.

* * * * *